United States Patent [19]

Wichinsky et al.

[11] Patent Number: 4,496,160

[45] Date of Patent: Jan. 29, 1985

[54] COIN PROJECTING AND TARGET GAME APPARATUS

[76] Inventors: Michael Wichinsky; LeRoy N. Gutknecht, both of 2607 S. Highland Dr., Las Vegas, Nev. 89109

[21] Appl. No.: 449,742

[22] Filed: Dec. 14, 1982

[30] Foreign Application Priority Data

Dec. 15, 1981 [GB] United Kingdom ..... 8137785

[51] Int. Cl.[3] ..... A63F 9/02

[52] U.S. Cl. ..... 273/369; 273/138 A; 273/376; 273/399; 273/402

[58] Field of Search ..... 273/355, 356, 357, 369, 273/375, 399, 405, 138 R, 138 A, 376, 402

[56] References Cited

U.S. PATENT DOCUMENTS

| | | | |
|---|---|---|---|
| 1,265,125 | 5/1918 | Siegel | 273/355 X |
| 2,424,016 | 7/1947 | Botts | 273/405 X |
| 2,783,754 | 3/1957 | Heiss | 273/357 X |
| 3,477,714 | 11/1969 | Garlington | 273/369 X |
| 4,089,525 | 5/1978 | Palazzolo | 273/375 |
| 4,123,059 | 10/1978 | Guibas | 273/356 |
| 4,303,248 | 12/1981 | Shoemaker et al. | 273/356 |

*Primary Examiner*—Anton O. Oechsle

*Attorney, Agent, or Firm*—Hamrick, Hoffman, Guillot & Kazubowski

[57] ABSTRACT

A game apparatus has a cabinet defining a playing area, a plurality of coin slots, and a rotable, ribbed, drum beneath the slots for projecting an accepted can within the playing area. In a lower portion of the playing area are two shelves onto which projected coins may fall, the shelves being traversed by pusher bars which push collected coins towards the edge of the respective shelf. In an upper portion of the playing area are a plurality of baskets containing sensors actuated by a coin passing through a basket to secure a predetermined award. Suitably one of the baskets is movable.

12 Claims, 7 Drawing Figures

COIN PROJECTING AND TARGET GAME APPARATUS

This invention relates to an improved game apparatus. Amusement apparatus in which coins are dropped onto a shelf traversed by pusher bars is well known. In such an arrangement the coins build up on the shelf until the constant movement of the pusher bars causes coins to fall off a forward edge of the shelf as an award.

An object of the present invention is to provide an improved game apparatus including skill and which, in the preferred embodiment, is combined with such known amusement apparatus.

According to the present invention a game apparatus comprises a cabinet defining a playing area, means for receiving a playing piece such as a coin, token or the like, means for projecting an accepted playing piece within the playing area, and a sensor, disposed within the playing area, which may be triggered by a projected playing piece, the sensor, on actuation by such contact, causing the apparatus to register a predetermined award.

Preferably, the sensor is movable and a plurality of fixed sensors are also disposed within the playing area.

This application is related to our corresponding U.S. Design patent application Ser. No. 208,048 filed 11/18/80 and entitled "Gaming Machine."

In the preferred embodiment of a game apparatus comprises a cabinet defining a playing area, means for receiving a playing piece such as a coin, token or the like, means for projecting an accepted playing piece within the playing area, a plurality of shrouded sensors in an upper portion of the playing area, at least one shelf onto which playing pieces may fall after projection, in a lower portion of the playing area, pusher means for traversing the at least one shelf surface so as to push collected playing pieces towards an edge of the shelf, and means for moving at least one of said shrouded sensors within the playing area, the sensors being actuated by contact with a playing piece and being operative to cause the apparatus to register a predetermined award.

The invention will now be described by way of example with reference to the accompanying drawings which illustrate a preferred embodiment of the game apparatus of the present invention in which.

Figure 1:
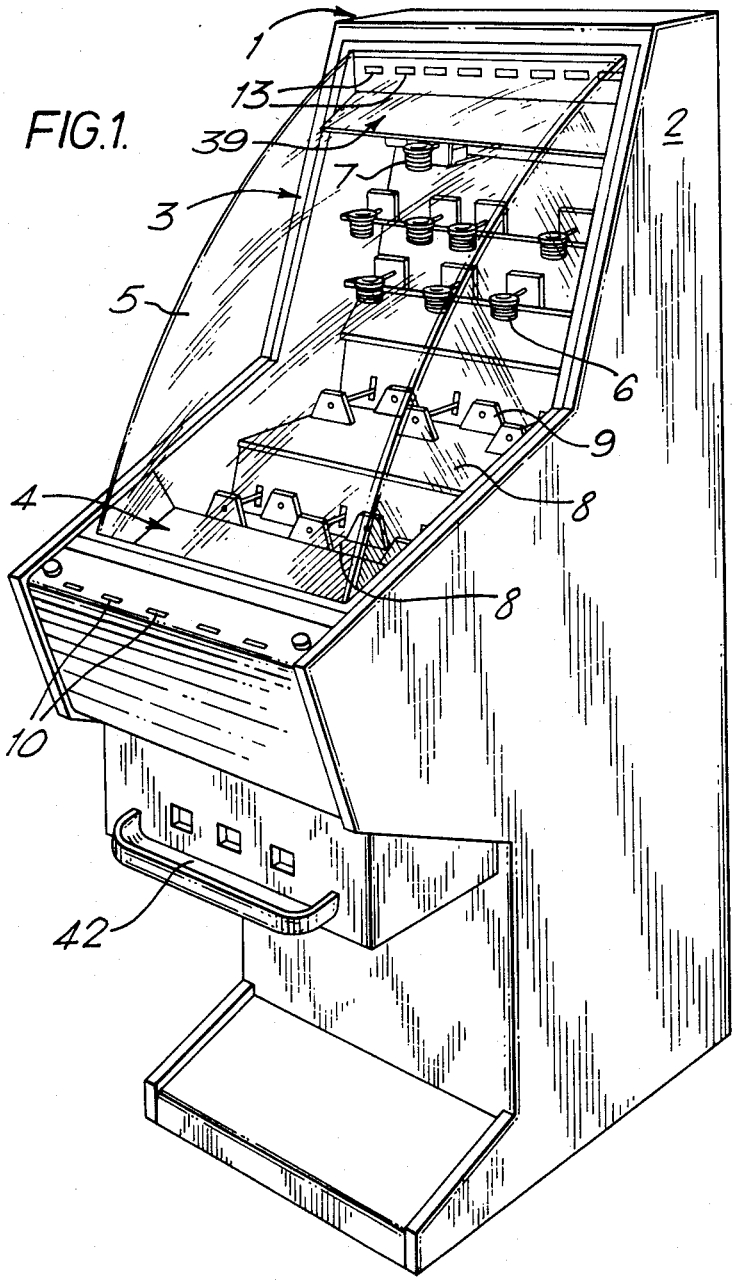
FIG. 1 is a front elevation.

In the drawings a game apparatus 1 comprises a cabinet 2 defining an upper portion 3 and a lower portion 4. The upper portion 3 has a transparent front panel 5 and includes a plurality of fixed baskets 6 projecting from the rear of the cabinet and a movable basket 7. The lower portion 4 includes two horizontally disposed shelves 8 staggered vertically one above the other and each including a plurality of pusher bars 9 which, in use, are continuously moved forwardly and rearwardly across the surface of the respective shelf 8 by crank means (not shown) in known manner.

Figure 7:
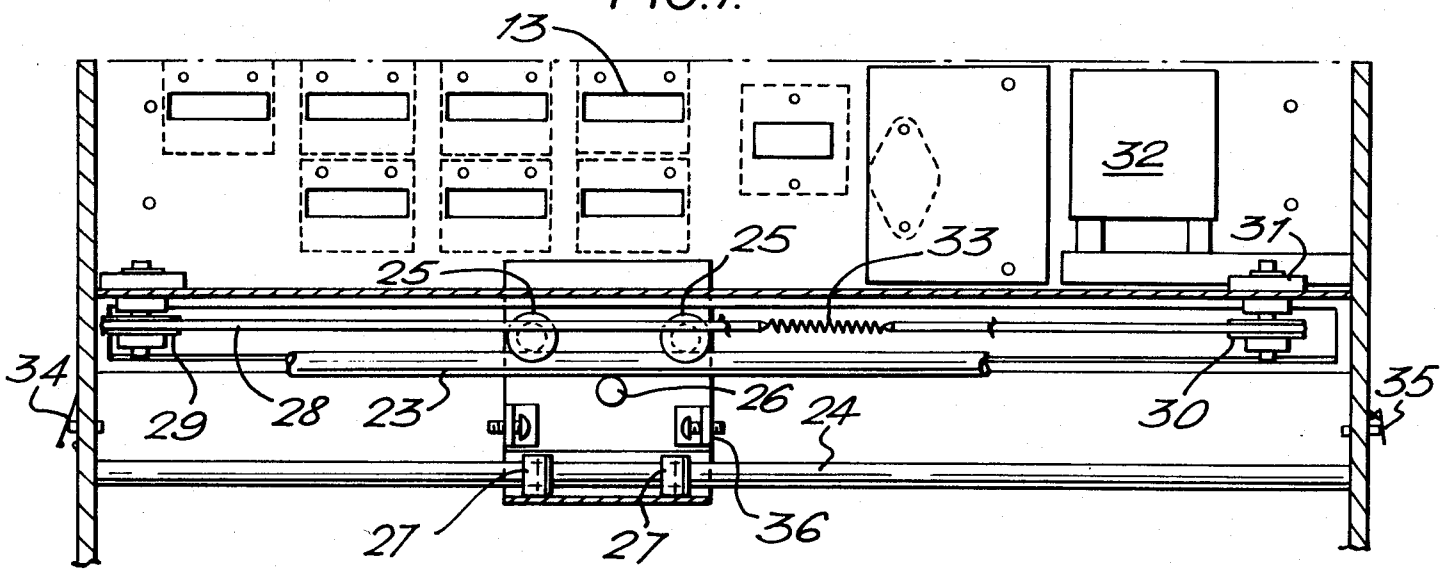
FIG. 7 is a front view in the direction of arrow C in FIG. 2 partially broken away.

The game apparatus 1 is coin-operated and the cabinet 2 includes a plurality of coin slots 10 disposed along a front edge 11. Each coin slot 10 includes a conventional mechanical coin detector 12 which detects incorrect coins by size, metal content or weight. An accepted coin triggers a switch to record the number of coins inserted in a particular coin slot on a respective meter housed at the top of the machine and generally indicated 13 in FIGS. 2 and 7.

Figure 4:
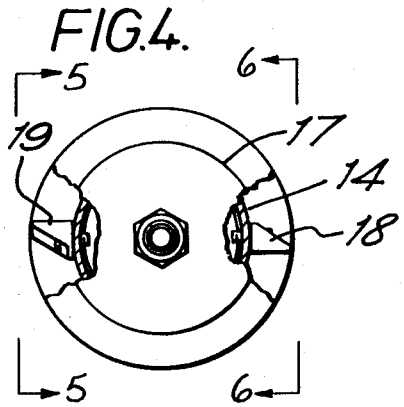
FIG. 4 is an end view of the drum in FIG. 3 partially broken away for clarity.

Located below the coin slots 10 is a rotatable flipper drum 14 which is driven through belts 15 by two 1550 RPM motors 16. The drum 14 is driven by two motors in order to provide a balanced drive such that the belts run with less tension: in addition the second motor serves as a back-up drive should one of the two drive belts ever break. The drum speed is preferably within 5% of 660 RPM in order to provide the desired results. The ends of the drum 14 each include a groove 17 which receives the respective belt 15 and the surface is provided with two sets of protruding, diametrically opposed, bars 18 and 19. The set of bars 28 are aligned with one another whereas the set of bars 19 are angled an about 5° as shown in FIG. 4. In use accepted coins from the coin slots 10 fall onto the rotating drum 14 and are projected by the protruding bars 18 and 19 into the playing area towards the baskets 6 and 7. The separation of the bars and the angles at which they are set provide random distribution of the projected coins within the playing area of the cabinet 2. Each of the baskets 6 and 7 includes a switch 20 which will be actuated by a coin passing through the basket so that an appropriate reward may be awarded as explained hereinafter.

In order to include an additional element of skill into the game the basket 7 is supported, by means of an arm 21, upon a frame 22 which is movable across the rear of the cabinet 2. The frame 22 is generally U-shaped in cross-section and rides upon two rails 23, 24 extending between the opposed sides of the cabinet 2. The rail 23 receives two spaced upper rollers 25 and a lower stabilising roller bearing 26, the rail 24 merely serves as a guide and is engaged by two roller centrally disposed bearings 27.

The basket 7 and frame 22 are driven by means of a steel cable 28 which is tensioned between a free pulley 29 and a pulley 30 affixed to the rotor 31 of a reversible motor 32 by a spring 33. The drive connection between the cable 28 and the frame 22 is by means of a pin (not shown) extending from the frame into engagement with the spring 33.

At each end of the transverse run of the basket 7 there is a switch 34,35 one of which is normally open and the other of which is normally closed. These switches are actuated alternately by a respective, adjustable screw which project laterally from mountings 36 on the frame 22. Actuation of the switches 34,35 operates a latch relay to reverse the motor 32 at the end of a traverse.

Figure 2:
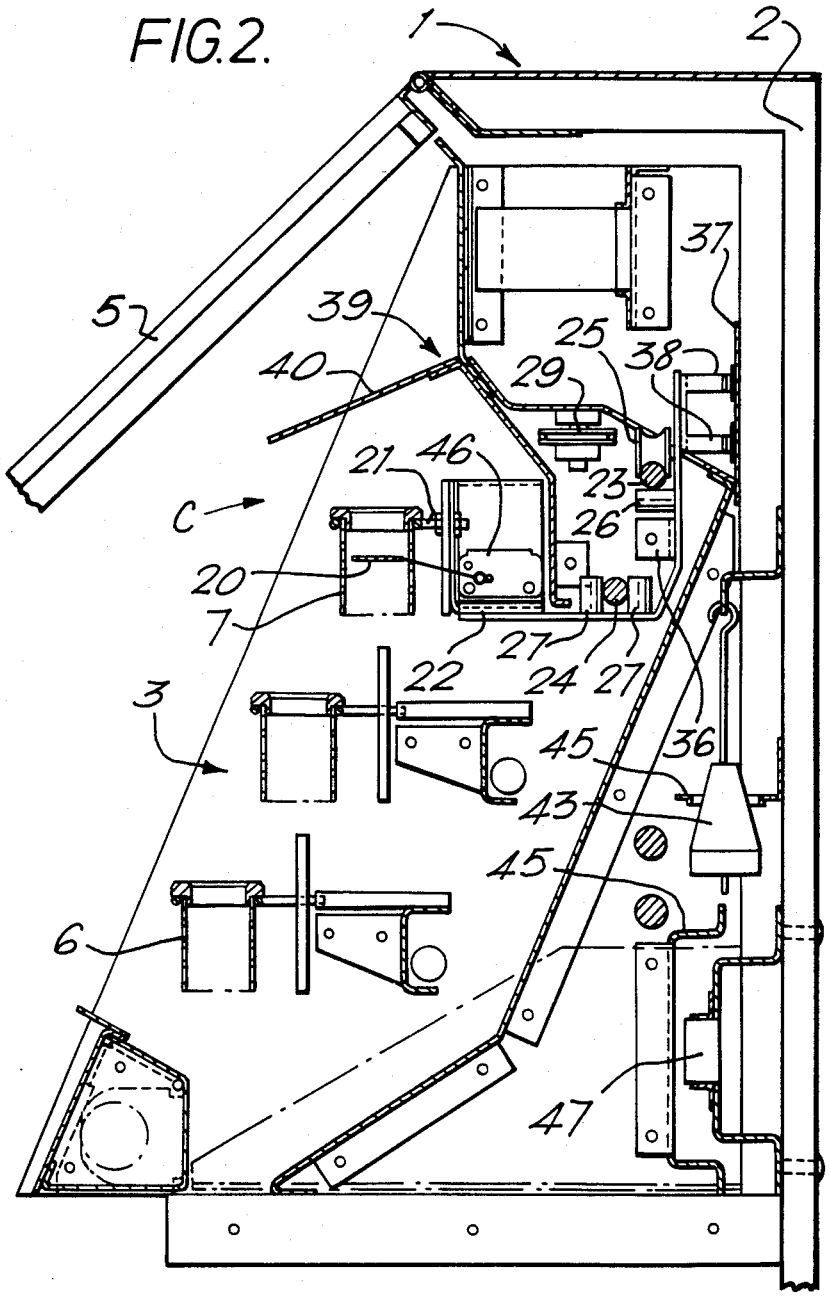
FIG. 2 is a side elevation of the upper portion of the apparatus.
Figure 3:
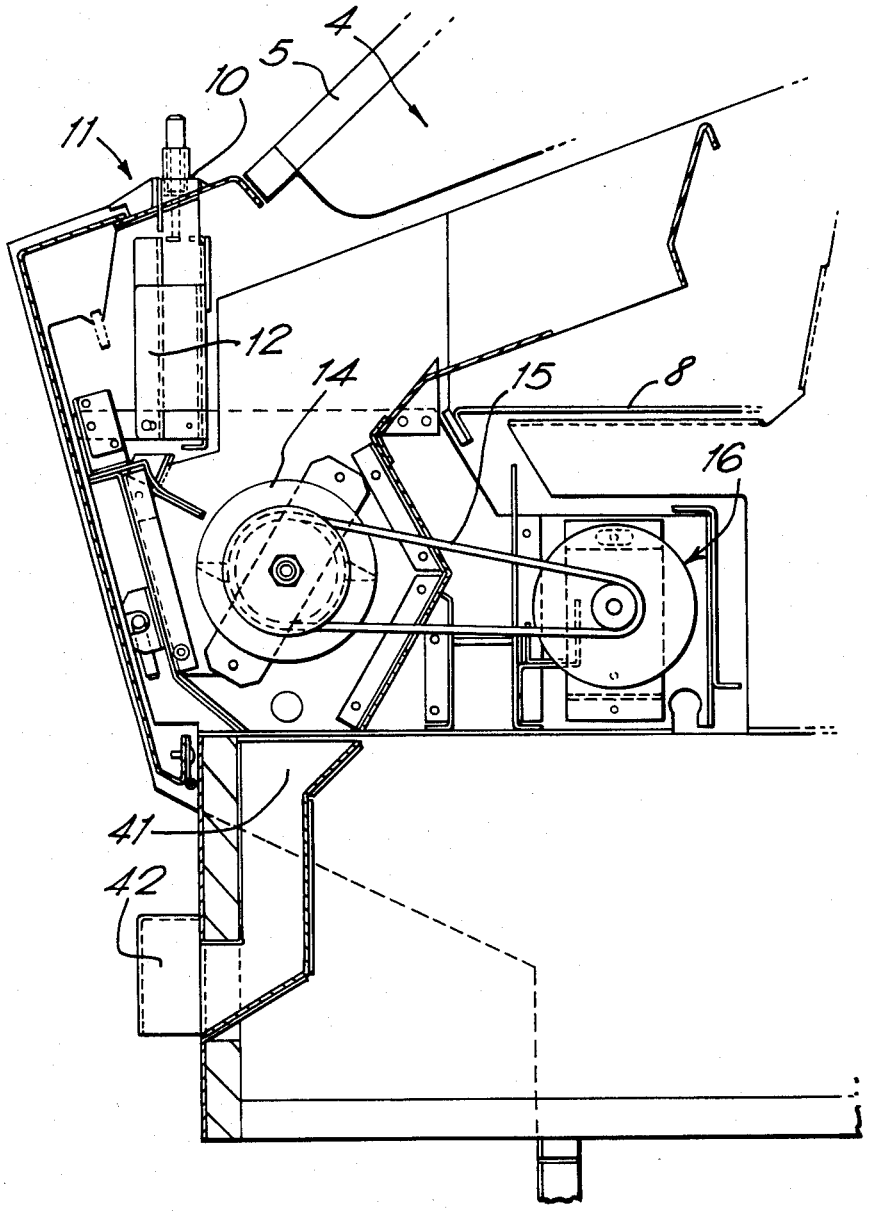
FIG. 3 is a side elevation of the lower portion of the apparatus.
Figure 5:
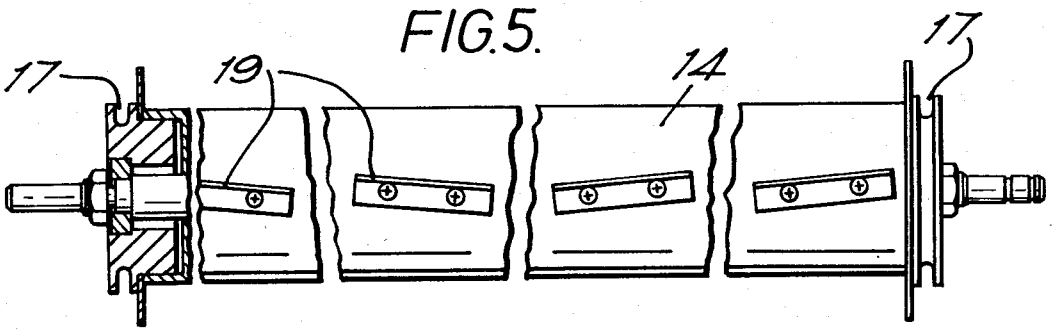
FIG. 5 is a view on 5—5 in FIG. 4.
Figure 6:
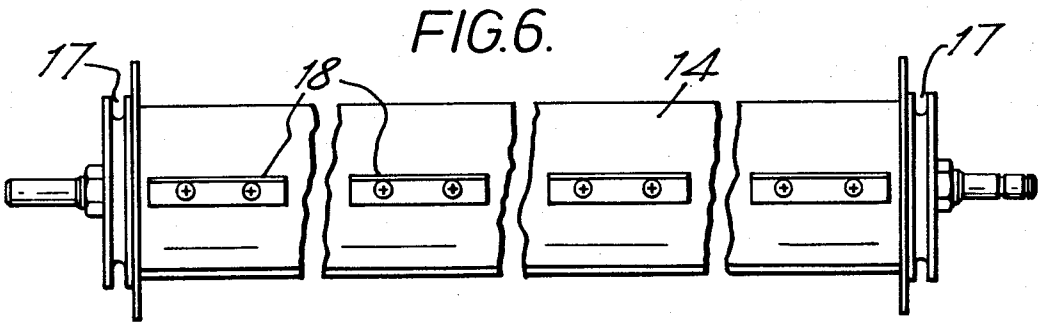
FIG. 6 is a view on 6—6 in FIG. 4.

FIG. 2 shows clearly the switch arrangement which consists of the low torque switch plate 20 within the basket 7 connected to the switch unit 36 mounted within the frame 22. In order to maintain electrical contact throughout the movement of the basket 7 a fixed printed circuit board contact 37 having two parallel tracks is provided at the rear of the frame 22 and this is traversed by two wiper contacts 38. The basket 7 moves across the cabinet at a speed of about 4 inches per second.

The shape of the hood 39 disposed above the basket 7 and its length is specially designed so that only coins which are projected by the drum 14 at the correct trajectory can pass into the basket 7. The forward portion 40 of the hood 39 is transparent.

In use the drum 14 rotates and the pusher bars 9 move across the surfaces of the shelves 8. The coins which are accepted by the detector are projected towards the baskets 6 and 7 and then drop down onto the shelves 8. If a coin passes through a basket as it drops the respective switch 20 is actuated which causes an appropriate award to be paid out from a coin counter in known manner. If a coin fails to be projected then the coin is returned via chute 41 to the collection tray 42 for further use.

As the game continues the coins build up on the shelves and, intermittently, the pusher bars 9 cause coins to be pushed over the edge of the shelf. This either causes coins to drop onto the shelf below or from the bottom shelf to a weight counter for payout; the counter recording the number of coins paid out and registering the recorded number on an appropriate meter at 13.

In view of the skill involved with respect to the moving basket 7 this carries the highest award. In order to win the award a player uses his skill to determine which coin slot 10 should be played at any particular time bearing in mind the position of the basket 7 during its traverse.

In order to protect the machine from abuse a pendulum sensor 43 and cantilevered shock sensor 44 are provided. Consequently, if a player strikes the machine or tries to tip it over in order to induce coins to become dislodged from the shelves 8, the sensors make electrical contact with their respective contacts 45, 47 such that the machine stops all pay-outs.

We claim:

1. A game apparatus comprising a cabinet defining a playing area, means for receiving and accepting or rejecting a playing piece such as a coin or token, means for projecting an accepted playing piece within the playing area, a plurality of shrouded sensors disposed within an upper portion of the playing area and which may be actuated by a projected playing piece and operative to cause the apparatus to register a predetermined award, and at least one shelf disposed in a lower portion of the playing area and onto which projected playing pieces may fall after projection, said shelf being traversed by pusher means which push playing pieces collected thereon towards an edge of the shelf.

2. A game apparatus according to claim 1 wherein the sensor is movable with respect to the cabinet.

3. A game apparatus according to claim 2 including a plurality of fixed sensors disposed within the playing area.

4. A game apparatus according to claim 3 wherein the shrouding of each sensor is in the form of a surrounding basket through which the playing pieces must pass in order to actuate the sensor by contact therewith.

5. A game apparatus according to claim 2 including at least one shelf onto which projected playing pieces may fall, said shelf or shelves being traversed by pusher means which push playing pieces collected thereon towards an edge of the shelf or shelves.

6. A game apparatus according to claim 2 wherein the means for projecting an accepted playing piece comprises a rotatable drum having a plurality of protruding bars therein onto which the playing piece drops by gravity to be projected into the playing area.

7. A game apparatus according to claim 1 wherein the means for projecting an accepted playing piece comprises a rotatable drum having a plurality of protruding bars therein onto which the playing piece drops by gravity to be projected into the playing area.

8. A game apparatus comprising a cabinet defining a playing area, means for receiving a playing piece such as a coin or token, means for projecting an accepted playing piece within the playing area, a plurality of shrouded sensors in an upper portion of the playing area, at least one shelf onto which playing pieces may fall after projection, in a lower portion of the playing area, pusher means for traversing the at least one shelf surface so as to push collected playing pieces towards and edge of the shelf, and means for moving at least one of said shrouded sensors within the playing area, the sensors being actuated by contact with a playing piece and being operative to cause the apparatus to register a predetermined award.

9. A game apparatus according to claim 8 wherein the said at least one shrouded sensor is movable to and fro across the playing area by means of a reversible drive motor, the said at least one shrouded sensor maintaining electrical contact with the apparatus by means of a wiping contact with an elongate contact fixed to the cabinet.

10. A game apparatus according to claim 9 wherein the at least one shrouded sensor is disposed below a hood having a free edge projecting downwardly and forwardly of a leading edge of the said sensor.

11. A game apparatus according to claim 1 wherein the means for receiving a playing piece includes a plurality of playing piece receiving slots.

12. A game apparatus according to claim 8 wherein the means for receiving a playing piece includes a plurality of playing piece receiving slots.

* * * * *